US006679586B2

(12) United States Patent
Kobayashi et al.

(10) Patent No.: US 6,679,586 B2
(45) Date of Patent: Jan. 20, 2004

(54) INKJET RECORDING DEVICE CAPABLE OF PERFORMING INK REFRESH OPERATION WITHOUT STOPPING PRINTING OPERATION

(75) Inventors: Shinya Kobayashi, Hitachinaka (JP); Takahiro Yamada, Hitachinaka (JP); Kunio Satou, Hitachinaka (JP); Hitoshi Kida, Hitachinaka (JP)

(73) Assignee: Hitachi Printing Solutions, Ltd., Kanagawa-ken (JP)

( * ) Notice: Subject to any disclaimer, the term of this patent is extended or adjusted under 35 U.S.C. 154(b) by 0 days.

(21) Appl. No.: 10/242,781

(22) Filed: Sep. 13, 2002

(65) Prior Publication Data

US 2003/0058306 A1 Mar. 27, 2003

(30) Foreign Application Priority Data

Sep. 21, 2001 (JP) ..... P2001-288103

(51) Int. Cl.[7] ..... B41J 2/06; B41J 2/04; B41J 29/38

(52) U.S. Cl. ..... 347/55; 347/9; 347/10; 347/11; 347/54

(58) Field of Search ..... 347/54, 55, 9–15, 347/68–72

(56) References Cited

U.S. PATENT DOCUMENTS 5,278,582 A * 1/1994 Hongo ..... 347/14
5,563,634 A * 10/1996 Fujii et al. ..... 347/9
RE37,862 E * 10/2002 Hertz et al. ..... 347/15
6,494,555 B1 * 12/2002 Ishikawa ..... 347/10

FOREIGN PATENT DOCUMENTS

JP 57-61576 4/1982
JP 9-29996 2/1997

* cited by examiner

*Primary Examiner*—Stephen D. Meier
*Assistant Examiner*—An H. Do
(74) *Attorney, Agent, or Firm*—Whitham, Curtis & Christofferson, PC

(57) ABSTRACT

A sheet-position synchronizing signal is generated once each time a recording sheet is transported by a single-line worth of distance in a sheet feed direction. A print-driving signal and a refresh-driving signal are generated within a time interval of two successive sheet-position synchronizing signal. When the print-driving signal is applied to a piezoelectric element of a nozzle, then a print ink droplet is ejected, thereby a dot is formed on a recording sheet. On the other hand, when the refresh-driving signal is applied to the piezoelectric element, then a negatively-charged refreshing ink droplet is ejected. The refresh ink droplet refreshing ink droplet is deflected by an electric field and collected by a metal mesh without reaching the recording sheet.

15 Claims, 11 Drawing Sheets

INKJET RECORDING DEVICE CAPABLE OF PERFORMING INK REFRESH OPERATION WITHOUT STOPPING PRINTING OPERATION

BACKGROUND OF THE INVENTION

1. Field of the Invention

The present invention relates to an on-demand type inkjet recording device, and more specifically a line-scanning type high-speed inkjet recording device having a plurality of nozzles.

2. Related Art

There have been proposed a continuous inkjet recording device that continuously ejects ink droplets and an on-demand inkjet recording device that ejects ink droplets only when needed.

Because the on-demand inkjet recording device ejects ink droplets only when needed, non-ink-ejection periods occur during printing operations. When a water-based ink is used in such an on-demand type inkjet recording device, the water-based ink clinging around nozzles evaporates and thus gets dense during the non-ink-ejection periods. Condensed ink prevents proper ink ejection, and in a worse case blocks off the nozzles, thereby disabling ink ejection.

Although such a problem does not occur in the continuous-type inkjet recording device, this is a serious problem in the on-demand type inkjet recording device.

In order to overcome this problem, Japanese Patent-Application Publication No. SHO-57-61576 has proposed a device that performs ink vibration for generating vibration in ink inside the nozzles by applying a driving energy smaller than that for ejecting ink to a piezoelectric element. In this manner, ink solidification is prevented, and thus clogging in the nozzles due to solidified ink is prevented. However, because the ink vibration cannot prevent evaporation of ink, if ink ejection is not performed over a long time period, then the ink will be gradually condensed, resulting in improper ink ejection or even ejection failure.

Japanese Patent-Application Publication NO. HEI-9-29996 has proposed a device that overcomes the above problem by performing ink refresh operations in addition to the ink vibrations. In the ink refresh operations, a recording head ejects refresh ink droplets to remove defective ink from the nozzles. Because the condensed ink is removed from and fresh ink is supplied to the nozzles, preferable ink ejection performance is reliably maintained.

However, this ink refresh operation cannot be performed in a printing region where the recording head is in confrontation with a recording sheet. Accordingly, when the ink refresh operation is needed during the printing operation, it is necessary to stop the printing operation and to move the recording head out of the printing region. This requires a considerable amount of time, and reduces the overall printing speed, and also wastes ink. However, decreasing the frequency of the ink refresh operations in order to accelerate the printing speed and to save the ink increases the danger of nozzle clogging due to condensed ink.

Also, there has been provided a line-scanning-type recording device that includes a recording head formed with nozzle arrays. Because the recording head has a width equivalent to the entire width of a recording sheet, printing is performed on the recording sheet that is being transported in its lengthwise direction relative to the recording head without moving the recording head in the widthwise direction across the recording sheet. With this configuration, the printing operation is performed at high speed.

In this line-scanning type recording head, however, it is difficult to stop the high-speed printing operation for the ink refresh operation. Moreover, it takes long time to move the recording head out of a printing region. Although it is conceivable to perform the ink refresh operation between pages, this is impossible when a continuous sheet rather than cutout sheets is used.

Moreover, once the printing operation is started in the high-speed inkjet recording device, such as the above mentioned line-scanning type recording device, that prints at 100 ppm (page/minute) or more, the recording device is expected to continue the printing more than ten minutes (1,000 pages or more) without stop. Accordingly, in order to satisfy this ten-minute requirement, it is necessary to maintain the proper ink ejection by the ink vibrations alone without the ink refresh operations.

However, the effect of the ink vibration on ink ejection performance lasts for only several seconds to several tens of seconds. Also, because there are usually several million of nozzles formed in a single line-scanning type recording head, it is extremely difficult to keep each of the nozzles in good ejection condition for more than ten minutes by the ink vibration only.

SUMMARY OF THE INVENTION

It is an objective of the present invention to overcome the above problems and to provide an on-demand ink jet recording device capable of maintaining its proper ink ejection without stopping printing operation.

In order to achieve the above and other objects, there is provided an inkjet recording device including an ejection means for ejecting ink droplets and a driving signal generation means for generating a print-driving signal and a maintenance signal. The ejection means ejects print ink droplets as the ink droplets when the print-driving signal is generated, and the ejection means performs maintenance operations when the maintenance signal is generated. The print ink droplets reach a recording medium to form dots on the recording medium. The print-driving signal is repeatedly generated at a predetermined time interval, and the maintenance signal is repeatedly generated at the predetermined interval in a time phase different from the print-driving signal.

PREFERRED EMBODIMENT OF THE PRESENT INVENTION

Next, an inkjet recording device according to an embodiment of the present invention will be described while referring to the attached drawings.

Figure 1:
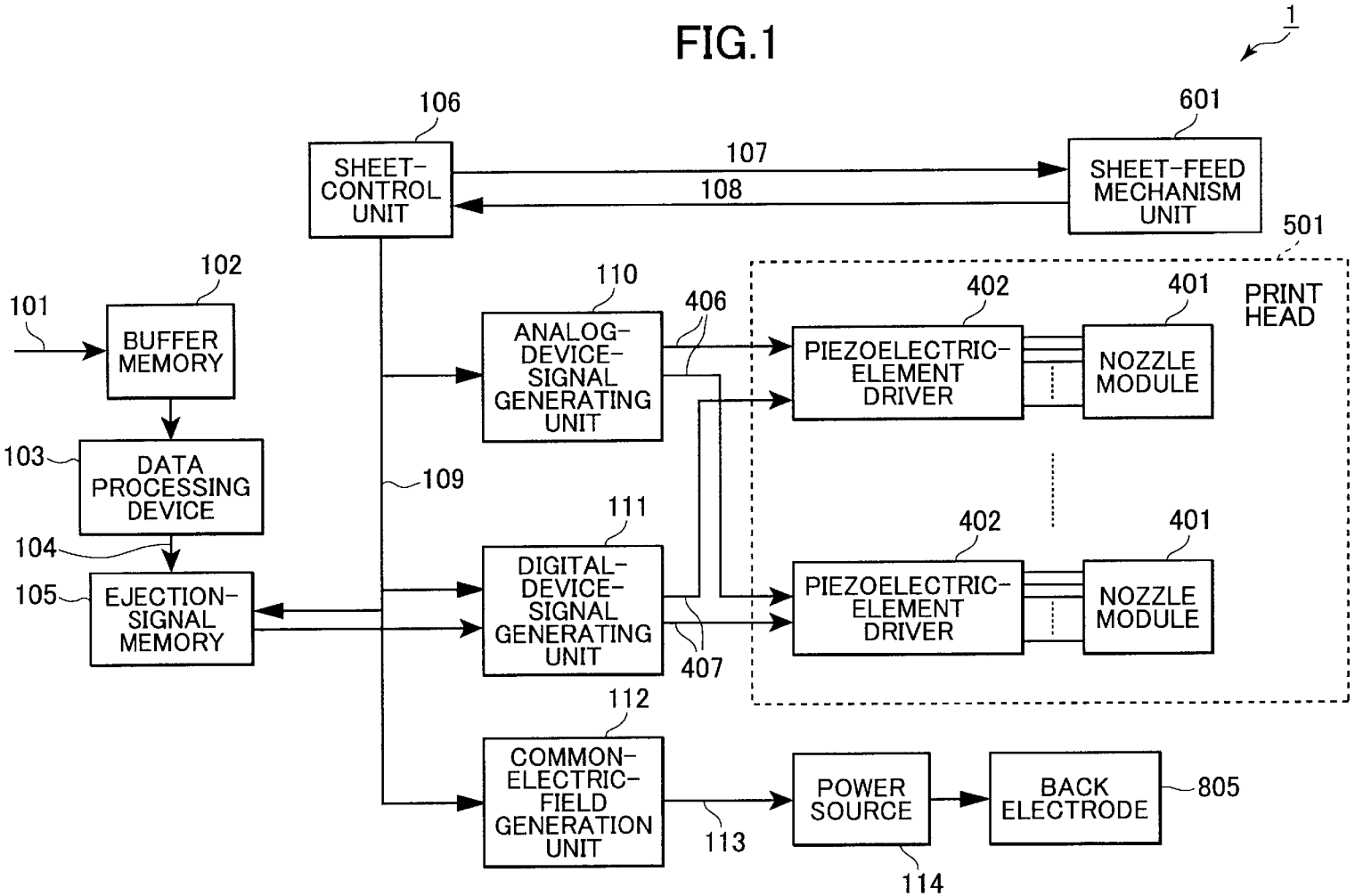
FIG. 1 a block diagram showing a configuration of a print device according to an embodiment of the present invention.
Figure 2:
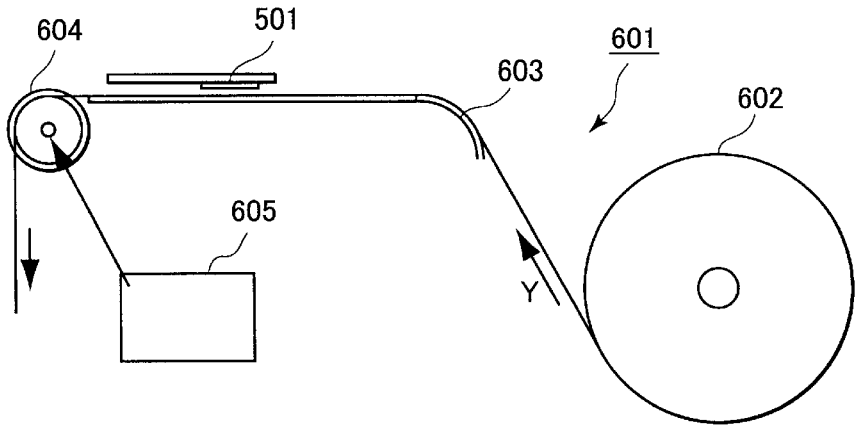
FIG. 2 is a plan view of a sheet-feed mechanism of the print device of FIG. 1.

First, a configuration of an inkjet recording device 1 will be described. As shown in FIG. 1, the inkjet recording device 1 includes a sheet-feed mechanism unit 601 and a print head 501 mounted on the sheet-feed mechanism unit 601. As shown in FIG. 2, the sheet-feed mechanism unit 601 includes a guide 603, a sheet-feed roller 604, and a rotary encoder 605. Although not shown in the drawings, the sheet-feed mechanism unit 601 further includes a sheet transport mechanism that transports a rolled uncut recording sheet 602 in a sheet feed direction indicated by an arrow Y, introduces the same to a position directly beneath the print head 501, which forms images on the recording sheet 602, and discharges the recording sheet 602 via the sheet-feed roller 604. The rotary encoder 605 is attached to the sheet-feed roller 604 for detecting the position of the recording sheet 602. A motor (not shown) is also attached to the sheet-feed roller 604.

As shown in FIG. 1, the print head 501 includes a plurality of nozzle modules 401 and a plurality of piezoelectric-element drivers 402 in one-to-one correspondence with the nozzle modules 401. In the present embodiment, 20 nozzle modules 401 and, thus, 20 piezoelectric-element drivers 402 are provided.

As shown in FIG. 1, the inkjet recording device 1 further includes a buffer memory 102, a data processing portion 103, such as a CPU, an ejection-data memory 105, a sheet-control unit 106, an analog-drive-signal generating unit 110, and a digital-drive-signal generating unit 111. Although not shown in the drawings, a computer system is connected to the inkjet recording device 1.

The buffer memory is for temporarily storing a single-job worth (plural-page worth) of bitmap data 101 transmitted from the computer system. Although there are various types of bitmap data, the bitmap data 101 used in this embodiment is monochromatic single-bit data, which indicates "print" when the bitmap data 101 is "1", and indicates "not-print" when the bitmap data 101 is "0". It should be noted that not only the monochromatic single-bit data, but also color bitmap data or multi-bit data could be easily used in the present invention by using a conventional expansion method. Because such a method is well-known, details are not described here.

During or after the bitmap data 101 is stored in the buffer memory 102, the data processing portion 103 consecutively converts the bitmap data 101 into ejection data 104 in a format suitable for the inkjet recording device 1 and stores the ejection data 104 into the ejection-data memory 105. When the ejection data 104 is all stored in the ejection-data memory 105, then the sheet-control unit 106 outputs a driving signal 107 commanding the sheet-feed mechanism unit 601 to start transporting the recording sheet 602. The rotary encoder 605 of the sheet-feed mechanism unit 601 outputs a pulse signal 108 indicating the position of the recording sheet 602 to the sheet-control unit 106.

Figure 5:
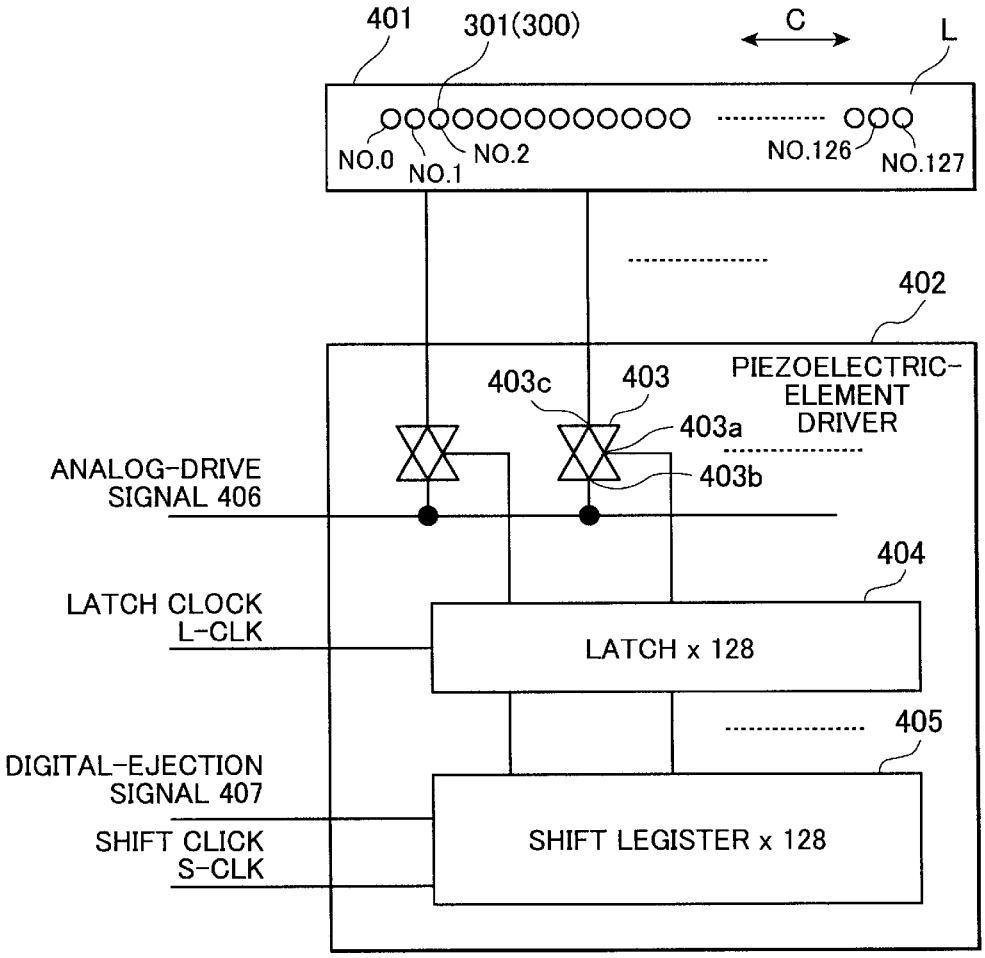
FIG. 5 is a block diagram showing a configuration of a piezoelectric-element driver of the print head.

When the recording sheet 602 reaches a predetermined recording position, the sheet-control unit 106 generates a sheet-position synchronizing signal 109 in accordance with a resolution of the print head 501, and outputs the signal 109 to the analog-drive-signal generating unit 110 and the digital-drive-signal generating unit 111, and also to the piezoelectric-element drivers 402 as shown in FIG. 5 as a latch clock L-CLK.

The analog-drive-signal generating unit 110 generates and outputs an analog drive signal 406 to all the piezoelectric-element drivers 402. Although the analog-drive-signal generating unit 110 provides the same analog drive signal 406 to all the piezoelectric-element drivers 402 in the present embodiment, it is possible to provide a different analog drive signal to each of the piezoelectric-element drivers 402 if, for example, characteristics vary among the nozzle modules 401. In the present embodiment, the analog drive signal 406 includes a print-driving signal 905 and a refresh-driving signal 904 (FIG. 10) to be described later.

The digital-drive-signal generating unit 111 retrieves the ejection data 104 from the ejection-data memory 105 and transmits the retrieved ejection data 104 to the piezoelectric-element drivers 402 as a digital ejection signal 407. In the present embodiment, the digital ejection signal 407 includes a print-ink ejection signal 407P and a refresh-ink ejection signal 407R (FIG. 10) to be described later. Also, the digital-drive-signal generating unit 111 generates and transmits a shift clock S-CLK (FIG. 5) to the piezoelectric-element drivers 402 and also to the ejection-data memory 105.

Next, the nozzle modules 401 of the print head 501 will be described in detail. As shown in FIG. 5, each nozzle module 401 is formed with a plurality of nozzles 300 having an orifice 301, which define a nozzle line L extending in a line direction C. In the present embodiment, each nozzle module 401 is provided with 128 nozzles 300 numbered starting from 0 to 127 (nozzles Nos. 0 through 127). That is, total of 2,560 nozzles 300 (128 nozzles×20 nozzle modules) are provided in the print head 501. A nozzle pitch with respect to the line direction C is 75 nozzle/inch (npi).

Figure 3:
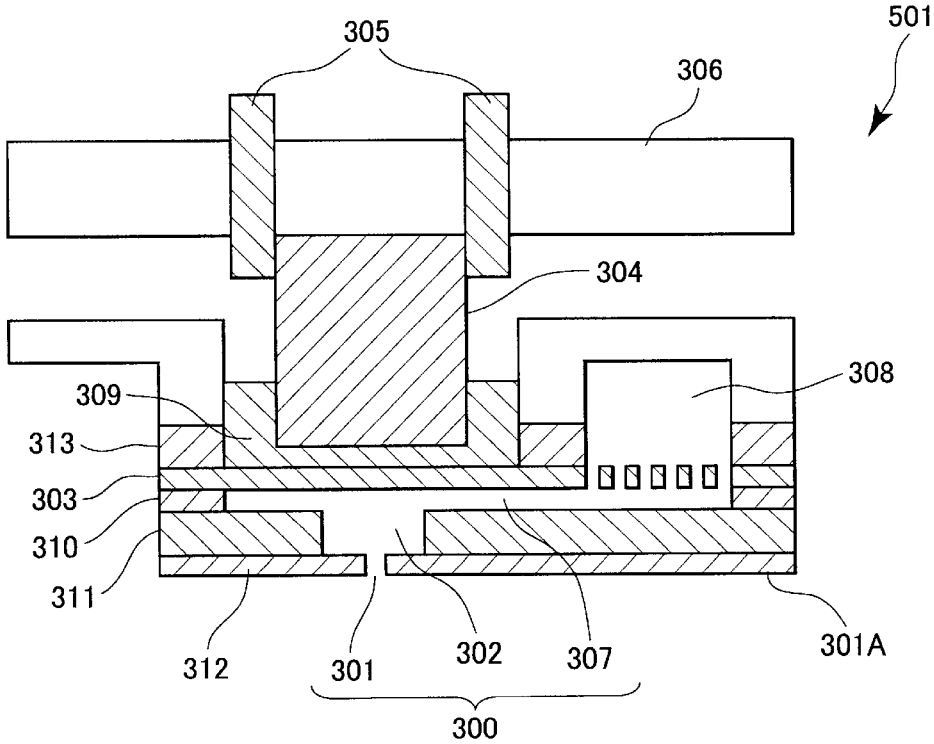
FIG. 3 is a cross-sectional view of one of nozzle module of the print device.

FIG. 3 shows a cross-sectional view of the nozzle module 401. As shown in FIG. 3, each nozzle module 401 is formed with the plurality of nozzles 300 (only one is shown in FIG. 3) and a common ink supply channel 308 that distributes ink to the nozzles 300, and includes an orifice plate 312 having a nozzle surface 301A, a restrictor plate 310, a pressure-chamber plate 311, a supporting plate 313, and a piezoelectric element supporting substrate 306. Each nozzle 300 includes an orifice 301 formed in the orifice plate 312, a pressure chamber 302 formed in the pressure-chamber plate 311, and a restrictor 307 formed in the restrictor plate 310. The restrictor 307 fluidly connects the common ink supply channel 308 to the pressure chamber 302 and regulates the ink flow into the pressure chamber 302.

Further, each nozzle 300 is provided with a diaphragm 303, and a piezoelectric element 304 attached to the diaphragm 303 by a resilient material, such as a silicon adhesive. The piezoelectric element 304 has a pair of signal input terminals 305. The piezoelectric element 304 deforms when a voltage is applied to the signal input terminal 305, and maintains its initial shape when a voltage is not applied. The supporting plate 313 supports the diaphragm 303.

The diaphragm 303, the restrictor plate 310, the pressure-chamber plate 311, and the supporting plate 313 are all formed from stainless steel, for example. The orifice plate 312 is formed from nickel material. The piezoelectric element supporting substrate 306 is formed from an insulating material, such as ceramics and polyimide.

In the above configuration, ink supplied from an ink tank (not shown) is distributed to the restrictors 307 via the common ink supply channel 308 and supplied into the pressure chambers 302 and the orifices 301. When a voltage is applied to one of the signal input terminals 305, then the piezoelectric element 304 deforms, whereby ink inside the pressure chamber 302 is ejected as an ink droplet through the orifice 301.

Figure 4:
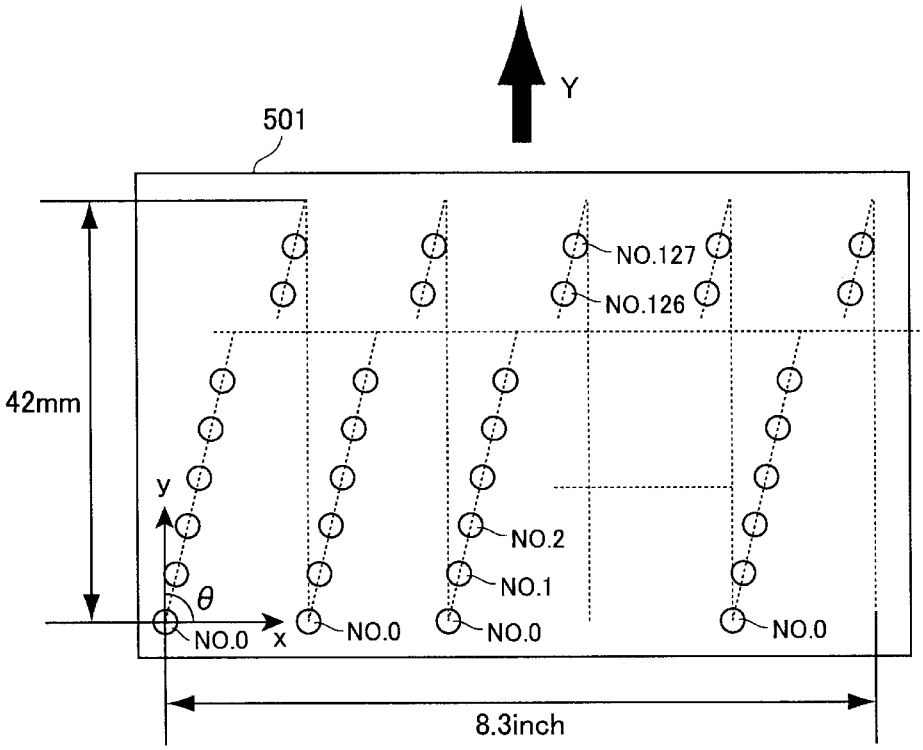
FIG. 4 is an explanatory plan view showing a nozzle surface of the print device on which a coordinate system is defined.

In order to facilitate the explanation, x-y coordinate system is defined, as shown in FIG. 4, on the nozzle surface 301A of the print head 501, wherein the y axis is parallel to the sheet-feed direction Y, and x axis is parallel to a widthwise direction of the recording sheet 602. A location of the center of each orifice 301 is expressed by a coordinate value (nx, ny).

As shown in FIG. 4, the nozzle modules 401 are arranged side by side in the x direction while the nozzle line L defines an angle θ with respect to the x direction. With this configuration, a nozzle pitch with respect to the y direction (sheet feed direction Y) is increased more than 75 npi, which is the nozzle pitch with respect to the line direction C. Here, in the present embodiment, images with 309 dot/inch (dpi) in both the x and y directions are formed, so that the angle θ is set such that tan θ=4. In this manner, the nozzle pitch in the x direction becomes 309 npi, which is 20 times the nozzle pitch in the y direction.

The nozzle modules 401 has a length of approximately 42 mm in the y direction and a width of approximately 8.3 inches in the x direction, enabling to form images on a recording sheet having a width of a A4-sized cutout sheet. It should be noted that in a multicolor printer, four or more print heads 501 having the above configuration are provided for different colored ink, such as cyan, magenta, yellow, and black. In the present embodiment, however, it is assumed that only a single print head 501 is provided in order to simplify the explanation.

Next, configuration of the piezoelectric-element drivers 402 will be described in detail. As shown in FIG. 5, each piezoelectric-element driver 402 includes 128 analog switches 403 in one-to-one correspondence with the nozzles 300, the latch 404 connected to all the analog switches 403, and a shift register 405 connected to the latch 404. The digital ejection signal 407 and the shift clock S-CLK both from the digital-drive-signal generating unit 111 are input to the shift register 405. The digital ejection signal 407 is a 128-bit serial data corresponding to the 128 nozzles 128. The digital ejection signal 407 having a value "1" indicates "ejection", and the digital ejection signal 407 having a value "0" indicates "non-ejection". In accordance with the digital-ejection signal 407, the shift register 405 outputs a 128-bit parallel data to the latch 404. In addition to the 128-bit parallel data, the latch clock L-CLK is also input to the latch 404.

The analog switch 403 has a switch terminal 403*a*, an input terminal 403*b*, and an output terminal 403*c*. An output signal from the latch 404 is input to the switch terminal 403*a*, and the analog drive signal 406 is input to the input terminal 403*b*. When a signal of "1" is input to the switch terminal 403*a*, then the analog switches 403 output, through the output terminal 403*c*, the analog drive signal 406 received at the input terminal 403*b*, whereas when a signal of "0" is input to the switch terminal 403*a*, then the analog switches 403 open the output terminal 403*c*. Here, the output terminal 403*c* is connected to one of the signal input terminals 305 of the corresponding nozzle 300, and the another one of the signal input terminals 305 is grounded. That is, the analog drive signal 406 is a driving signal commonly used for all the 128 nozzles 300 of the corresponding nozzle module 401 in order to drive the 128 piezoelectric elements 304. Although the analog drive signal 406 of the present embodiment has a trapezoid waveform as shown in FIG. 6, there have been provided various kinds of waveforms that could be used in the present embodiment.

Figure 6:
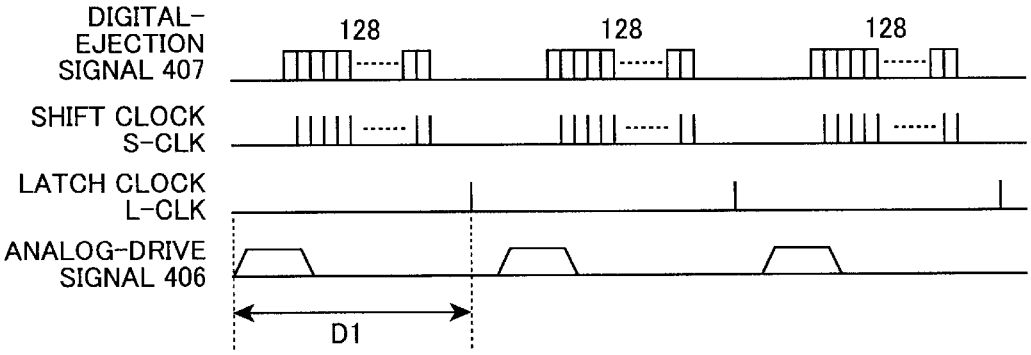
FIG. 6 is a general timing chart of the piezoelectric-element driver.

FIG. 6 shows a general timing chart of the piezoelectric-element drivers 402. As shown, the digital ejection signal 407 is sequentially stored in the shift register 405 in synchronization with the shift clock S-CLK. When 128 digital ejection signals 407 is stored, all the 128 digital ejection signals 407 are stored in the latch 404 at once in synchronization with the latch clock L-CLK and output to the switch terminal 403*a* of the analog switches 403. At the same time, the analog drive signal 406 is input to the input terminal 403*b* of the analog switches 403. As a result, ink droplets are ejected from the nozzles 300 corresponding to the digital ejection signal 407 of "1", whereas no ink droplet is ejected from the nozzles 300 corresponding to the digital ejection signal 407 of "0".

Here, because the resolution of the images in the y direction is 309 dpi as mentioned above, the sheet-position synchronizing signal 109 (latch clock L-CLK) is generated once each time the recording sheet 602 is transported by a distance of 1/309 inch in the sheet feed direction Y. In other words, the sheet-position synchronizing signal 109 (latch clock L-CLK) is generated with a time interval D1 (FIG. 6) equivalent to a time duration required for forming one-line worth of image. However, this time duration will fluctuate depending on variation in sheet feed speed.

In addition to the above configuration, the inkjet recording device 1 is also provided with an ink-droplet deflecting mechanism, which will be next described in detail.

Figure 7:
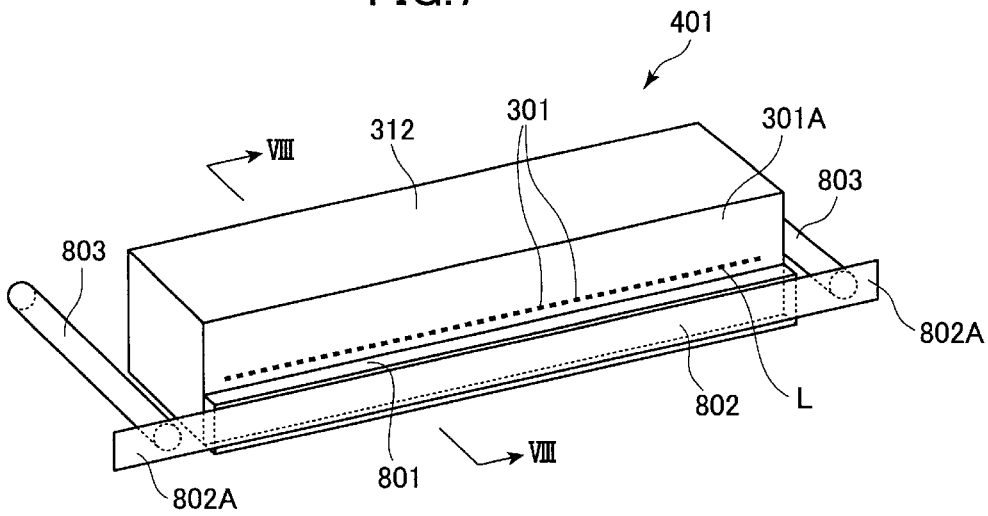
FIG. 7 is a perspective view of the nozzle module.
Figure 8:
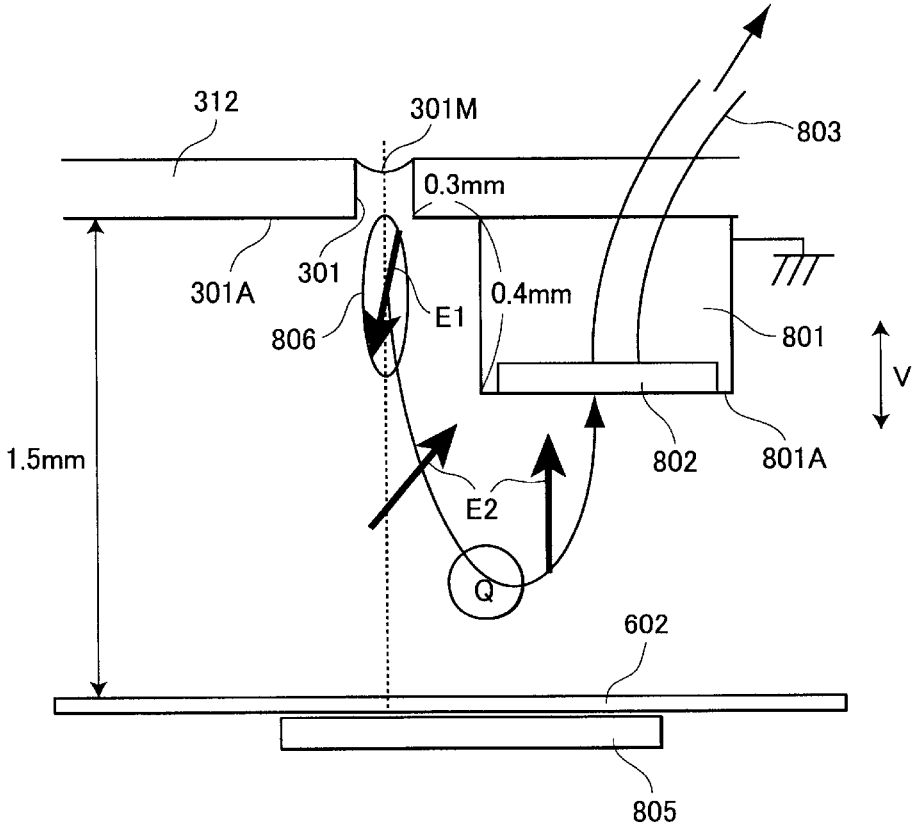
FIG. 8 is a cross-sectional explanatory view showing ink deflection.

As shown in FIGS. 7 and 8, the ink-droplet deflecting mechanism includes an ink-collect electrode 801 and a back electrode 805. The ink-collect electrode 801 is a plate-shaped electrode with a thickness of 0.4 mm, and is attached on the nozzle surface 301A in parallel with the nozzle line L with a distance of 0.3 mm therebetween such that there is a uniform positional relationship between the ink-collect electrode 801 and each nozzle 300. The ink-collect electrode 801 and the orifice plate 312 are both grounded. Provided in a surface 801A of the ink-collect electrode 801 is a metal mesh 802, which has a length longer than that of the ink-collect electrode 801, so that as shown in FIG. 7 both ends 802A of the metal mesh 802 protrude from the ink-collect electrode 801. A pair of tubes 803 made of vinyl are attached to the ends 802A and connected to pumps (not shown).

The back electrode 805, which is electrically insulated plate-shaped electrode, extends rear side of the recording sheet 602 in the nozzle direction C, which is perpendicular to the sheet surface of FIG. 8, such that there is a uniform positional relationship between the back electrode 805 and each nozzle 300. In the present embodiment, a distance from the orifice 301 to the surface of the back electrode 805 is 1.5 mm.

The ink-droplet deflecting mechanism of the present invention further includes, as shown in FIG. 1, a common-electric-field generation unit 112 and a power source 114. The common-electric-field generation unit 112 generates a common-electric-field signal 113 in synchronization with the sheet-position synchronizing signal 109. The power source 114 generates a high voltage in accordance with the common-electric-field signal 113, and applies the same to the back electrode 805. Because the orifice plate 312 and the ink-collect electrode 801 are both grounded, when the high voltage is applied to the back electrode 805, then an electric field is generated among the orifice plate 312 and the ink-collect electrode 801 and the back electrode 805.

Figure 9:
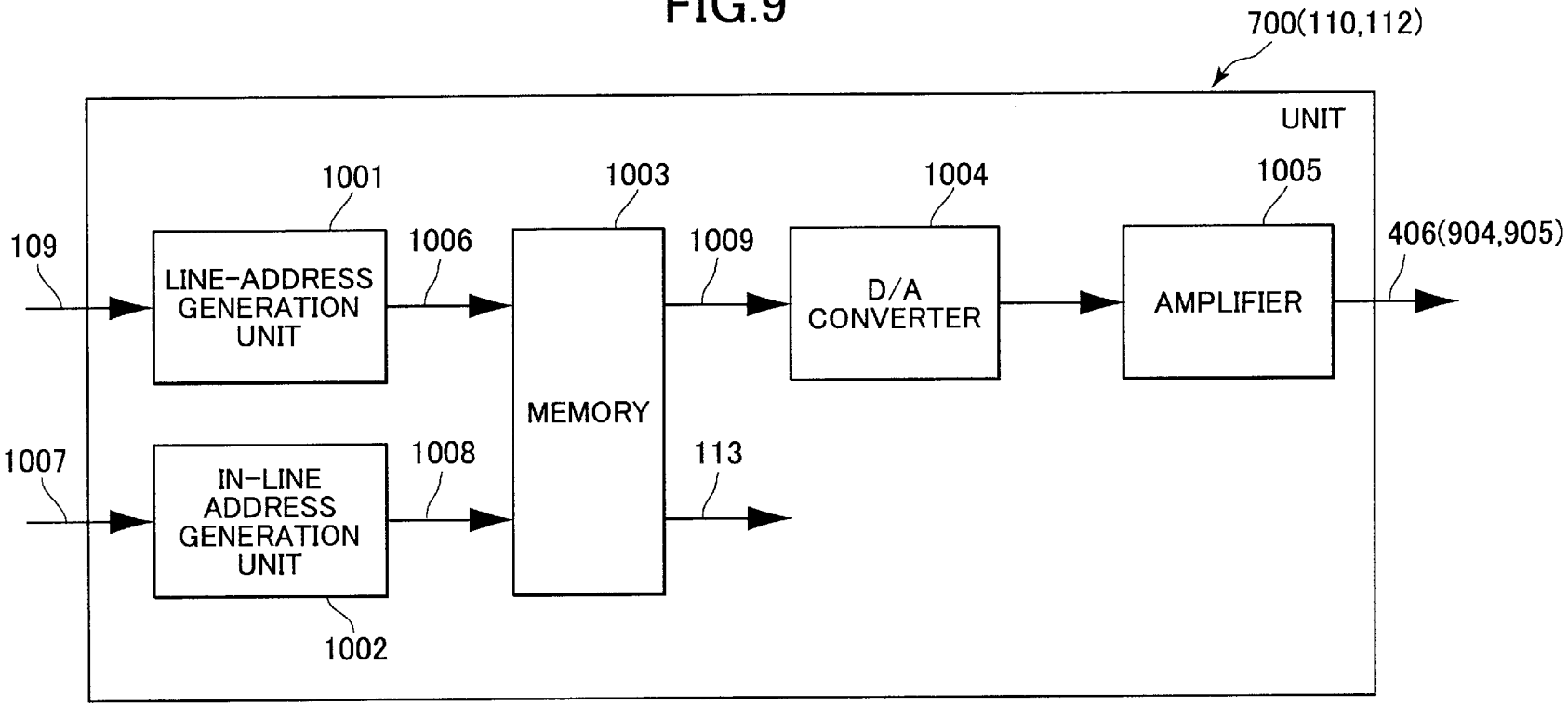
FIG. 9 is a block diagram of a unit serving as both a analog-drive signal generating unit and common-electric-field generation unit of the print device.

In practice, as shown in FIG. 9, a single unit 700 serves as both the analog-drive-signal generating unit 110 and the common-electric-field generation unit 112. The unit 700 includes a line-address generation unit 1001, an in-line address generation unit 1002, a memory 1003, a digital-to-analog (D/A) converter 1004, and an amplifier 1005. The line-address generation unit 1001 and the in-line address generation unit 1002 are formed of binary counters.

Here, "line" indicates a dot line extending in the widthwise direction on the recording sheet 602 onto which ink droplets ejected from the nozzles 300 form dots. In other words, "line" represents a location of each nozzle 300 or the print head 501 relative to the recording sheet 602 with respect to the sheet feed direction Y.

The line-address generation unit 1001 is reset when a print-start signal (not shown) is generated, counts up the sheet-position synchronizing signals 109, and generates 7-bit line address data 1006. The line-address generation unit 1001 repeatedly counts 128 sheet-position synchronizing signals 109 to repeatedly generate 128 sets of the line address data 1006 of "0" through "127" (0, 1, 2, . . . , 127, 0, 1, . . . ) indicating line addresses. The in-line address generation unit 1002 is reset each time the sheet-position synchronizing signal 109 is generated, counts up a high-frequency clock 1007, and generates 10-bit in-line address data 1008. In the present example, the high-frequency clock 1007 is 4 Mhz, and the sheet-position synchronizing signal 109 is generated approximately once every 200 μs. Hence, the in-line address generation unit 1002 counts approximately 800 high-frequency clock 1007 within 200 μs.

The memory 1003 is an ordinary memory that receives address data, outputs data, and prestores data that is necessary to generate the print-driving signal 905 and the refresh-driving signal 904. In the present embodiment, the memory 1003 receives the 7-bit line address data 1006 and the 10-bit in-line address data 1008, and outputs 10-bit data 1009 and 2-bit common-electric-field signal 113 once every 250 ns. The 10-bit data 1009 is D/A converted and amplified through the D/A converter 1004 and the amplifier 1005 to generate the analog drive signal 406 (refresh-driving signal 904 or print-driving signal 905)

Figure 10:
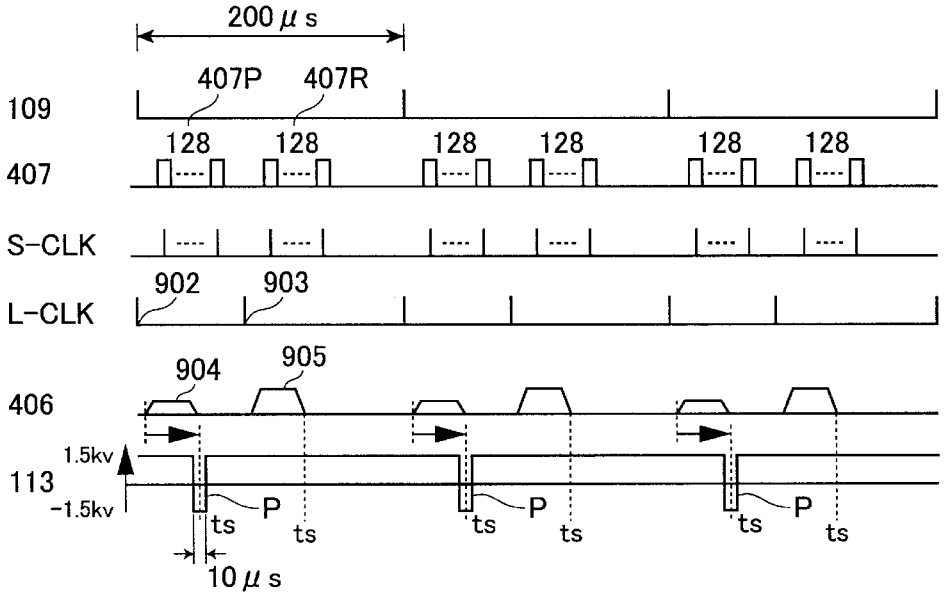
FIG. 10 is a timing chart of the piezoelectric-element driver.

FIG. 10 shows a timing chart of the piezoelectric-element driver 402 and the ink-droplet deflecting mechanism according to the present embodiment. When the sheet-position synchronizing signal 109 is generated, 128-bit print-ink ejection signal 407P is output during the first 80 μs and 128-bit refresh-ink ejection signal 407R is output during the subsequent 80 μs to the shift register 405 of the piezoelectric-element driver 402 in synchronization with the shift clock S-CLK. Because the time interval of the sheet-position synchronizing signals 109 is about 200 μs, about 40 μs left after the 128-bit refresh-ink ejection signal 407R is output. This 40 μs time duration serves as a margin that absorbs fluctuation in generation timing of the sheet-position synchronizing signal 109, i.e., the sheet feed speed. The latch clock L-CLK includes a first latch clock 902 and the second latch clock 903. The first latch clock 902 is output in synchronization with the sheet-position synchronizing signal 109 in order to latch the refresh-ink ejection signal 407R that the shift register 405 have previously received, and the second latch clock 903 is output 40 μs after the first latch clock 902 in order to latch print-ink ejection signal 407P which the shift register 405 have previously received.

The refresh-driving signal 904 is generated within 40 μs after the first latch clock 902, and the print-driving signal 905 is generated within 40 μs after the second latch clock 903. That is, both the refresh-driving signal 904 and the first latch clock 902 are repeatedly generated in the same time interval but in a different time phase.

The common-electric-field signal 113 has a deflection voltage of +1.5 kV with pulses P having a charging voltage of −1.5 kV. The pulse P has a width of 10 μs whose center is concurrent with an ink-droplet separation timing Ts (described later).

An ink droplet ejected in response to the print-driving signal 905 is a print ink droplet to print a dot on the recording sheet 602, whereas an ink droplet ejected in response to the refresh-driving signal 904 is a refreshing ink droplet, which will be next described in detail while referring to FIG. 8. First, the refreshing ink droplet will be described.

When the refresh-driving signal 904 is selectively applied to the piezoelectric elements 304, a refreshing ink droplet 806 shown in FIG. 8 is ejected. More specifically, ink is ejected through the orifice 301 with its rear portion still connected to a meniscus 301M. When the ejected ink elongates to a certain length, then the rear end separates from the meniscus 301M at the above-mentioned ink-droplet separation timing Ts, whereby the refreshing ink droplet 806 is formed. There has been known that the ink-droplet separation timing Ts maintains constant regardless of change in environmental factors or in the ink ejection speed.

In the present example, as shown in FIG. 10, the back electrode 805 is applied with the common-electric-field signal 113 of −1.5 kV around the ink-droplet separation timing Ts. Because the orifice plate 312 is grounded as described above, this generates an electric field E1 shown in FIG. 8. Although the direction of the electric field E1 slightly inclines to the left in FIG. 8 due to the existence of the ink-collect electrode 801, the direction near the orifice plate 312 is substantially perpendicular to the recording sheet 602, so that the refreshing ink droplet 806 is positively charged.

Then, almost immediately after the ink-droplet separation time Ts, the voltage of the common-electric-field signal 113 returns to the deflection voltage of +1.5 kV, so that an electric field E2 is generated. The electric field E2 has an upward direction and so decelerates the flying speed of the positively charged refreshing ink droplet 806 and forces the refreshing ink droplet 806 back toward the orifice plate 312. Here, because the direction of the electric field E2 is slightly inclined to the right in FIG. 8 due to the ink-collect electrode 801, thus deflected refreshing ink droplet 806 reaches the metal mesh 802 on the ink-collect electrode 801 without returning to the orifice 301. In this manner, the refreshing ink droplet 806 is collected by the metal mesh 802. Then, the ink reaches the tubes 803 due to the capillary action and discharged therethrough. Because the refreshing ink droplet 806 is collected to the metal mesh 802 without reaching to the recording sheet 602, it is possible to perform the ink refresh operations with the print head 501 facing to the recording sheet 602, that is, without moving the print head 501 out of a print region.

The position where the refreshing ink droplet 806 is reversed in its flying direction is determined in a formula:

$$L=m\times vo^2/(2\times q\times E)$$

wherein

L is a maximum distance from the orifice 301 toward the back electrode 805, i.e., a vertical direction V in this embodiment;

m is a mass of the refreshing ink droplet 806;

vo is an ejection velocity of the refreshing ink droplet 806;

q is a charging amount of the refreshing ink droplet 806; and

E is a component of the electric field E2 in the vertical direction V.

From the above formula, it is understood that the ejection speed can be set slow so as to reliably collect the refreshing ink droplets 806 in the metal mesh 802. Accordingly, in the present embodiment, the ejection speed of print ink droplets is set to 8 m/s, whereas the ejection speed of refreshing ink droplets 806 is set to 4 m/s.

A simple method to control the ejection speed is to change the electric current flowing through the piezoelectric element 304. In the present embodiment, the print-driving signal 905 has a voltage of 24 V, whereas the refresh-driving signal 904 is set to smaller voltage than the print-driving signal 905 to achieve the velocity vo of 4.0 m/s.

Next, a print ink droplet will be described. When the print-driving signal 905 is applied to the piezoelectric element 304, ink is ejected from the corresponding nozzle 300. When the ejected ink elongates to a certain length, the ink is separated from the meniscus 301M, whereby a print ink droplet (not shown) is formed. Although it is preferable not to apply any voltage to the back electrode 805 at the time of the separation, the common-electric-field signal 113 is maintained to the deflecting voltage of +1.5 kV at this time in order to facilitate the deflection of the refreshing ink droplet 806.

Accordingly, the print ink droplet is negatively charged. The negatively charged print ink droplet flies through the electric field E2, which accelerates the flying speed of the print ink droplet, and then the print ink droplet reaches the recording sheet 602 to form a dot thereon. Although the print ink droplet is slightly deflected to the left in FIG. 8 due to the ink-collect electrode 801, the print ink droplet is hardly influenced by the electric field E2 because of its high ejection speed (8 m/s) and thus the deflection amount thereof is insignificant.

Figure 12:
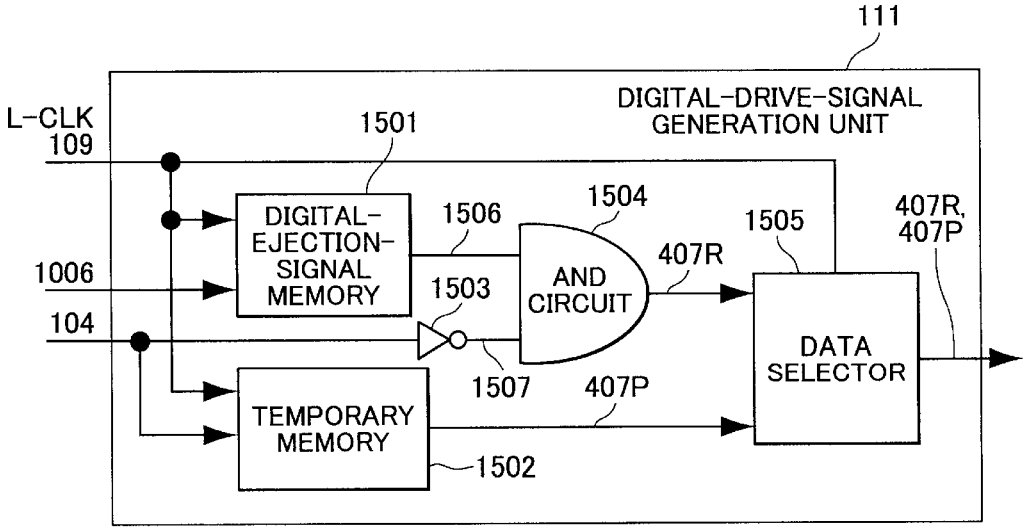
FIG. 12 is a block diagram of the digital-driving-signal generating unit.

FIG. 12 shows a configuration of the digital-drive-signal generating unit 111. The digital-drive-signal generating unit 111 includes a digital ejection signal memory 1501, a temporary memory 1502, an inverter 1503, an AND circuit 1504, and a data selector 1505. The digital ejection signal memory 1501 receives the line address data 1006 from the line-address generation unit 1001 shown in FIG. 9 and the sheet-position synchronizing signal 109 from the sheet-control unit 106, and outputs an ink-refresh digital ejection signal 1506 to the AND circuit 1504. The ink-refresh digital-ejection signal 1506 is prestored in the digital ejection signal memory 1501 for each orifice 301. The ink-refresh digital ejection signal 1506 includes signals of "1" and "0" for realizing a predetermined refresh ink ejection timing, such as the timing shown of FIG. 11 to be described later.

The inverter 1503 outputs an inverted signal 1507 of the ejection data 104 to the AND circuit 1504. Based on the inverted signal 1507 and the ink-refresh digital ejection signal 1506, the AND circuit 1504 outputs the refresh-ink ejection signal 407R that is either "1" or "0".

The ejection data 104 is input to the temporary memory 1502 also. Upon reception of a latch clock L-CLK, one-line worth of ejection data 104 is stored in the temporary memory 1502. Upon reception of a subsequent latch clock L-CLK, the temporary memory 1502 outputs the one-line worth of ejection data 104 as the digital ejection signal 407P to the data selector 1505. Then, within a time interval of the successive two latch clocks L-CLK, the data selector 1505 outputs the refresh-ink ejection signal 407R and the print-ink ejection signal 407P in this order. In this configuration, when the print-ink ejection signal 407P is "1", then the refresh-ink ejection signal 407R is automatically set to "0", so that image forming operation will not be performed simultaneously with the ink refresh operation. Here, if these operations are performed at the same time, the ink ejection frequency increases to double, preventing stabilized ink ejection. Because there is no need to perform the ink refresh operation as long as print ink droplets are ejected, this configuration is rational. On the other hand, when the print-ink ejection signal 407P is "0", then the digital-ejection signal 407 will be either "1" or "0" depending on the ink-refresh digital-ejection signal 1506.

Next, a first example of ink refresh operation performed in the print device 1 will be described. In the present example, the line-address generation unit 1001 (FIG. 9) is not used, so only the in-line address data 1008 is input to the memory 1003, and no line address data 1006 is output to the memory 1003.

Figure 11:
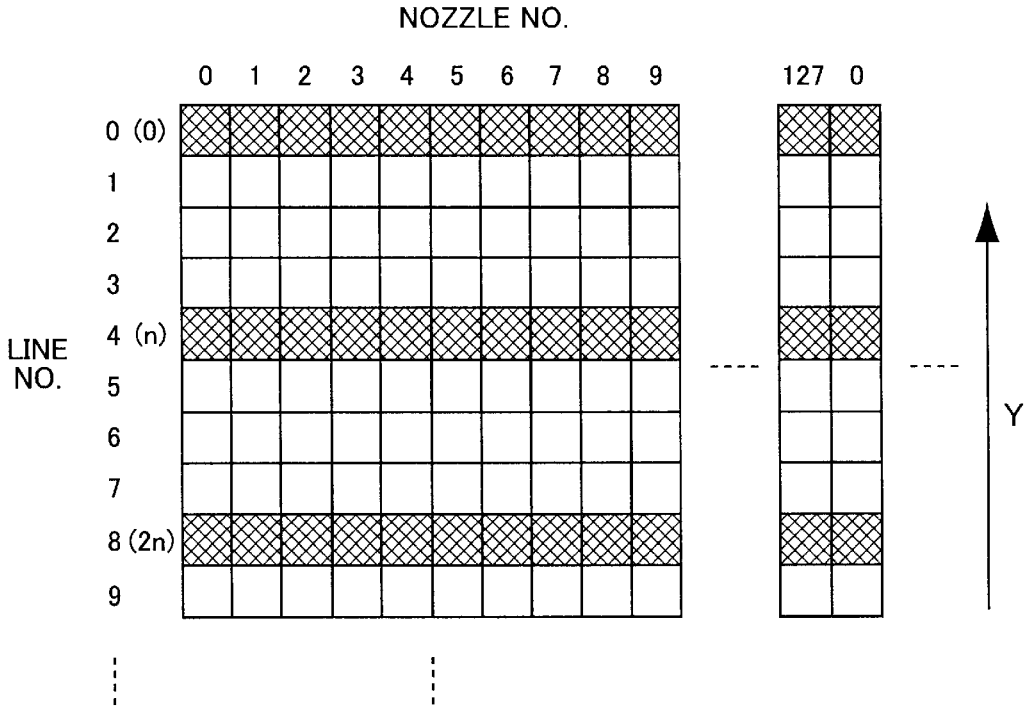
FIG. 11 is a first example of an ink-refresh digital-ejection signal.

FIG. 11 shows an ink-refresh digital-ejection signal 1506 (refresh-ink ejection signal 407R) of the first example. In FIG. 11, the ink-refresh digital-ejection signal 1506 is represented by a resultant dot pattern on the recording sheet 602 assuming that ejected refreshing ink droplets 806 reach the recording sheet 602 in order to facilitate the explanation. In other words, hatched cells represent the ink-refresh digital-ejection signal 1506 of "1", i.e., "ejection", and white cells represent the ink-refresh digital-ejection signal 1506 of "0", i.e., "non ejection". This is also same in FIG. 13 (describe later). Nos. 0 through 127 assigned to the 128 nozzles of a representative nozzle module 401 are shown in the horizontal direction, line Nos. are shown in the vertical direction. In the example shown in FIG. 11, the lines are repeatedly numbered starting from 0 in 309 dpi. In the example of FIG. 11, the ink-refresh digital-ejection signal 1506 of "1" is generated once every four lines, i.e., a period Pd is 4 (Pd=4).

Because the line direction C of the nozzles 300 is unparallel to the widthwise direction (x direction) as shown in FIG. 3, the actual ink ejection timing differs among the 128 nozzles 300 even through all the nozzles 300 eject refreshing ink droplet in the same lines. Accordingly, interferes among the nearby nozzles 300 are prevented, properly ejecting the refreshing ink droplets 806.

In this example, the ink-refresh digital-ejection signal 1506 for realizing the specific pattern shown in FIG. 11 is prestored in the digital-ejection signal memory 1501. However, it is possible that the processing portion 103 generates ink-refresh digital-ejection signal 1506 to achieve an optimum pattern in accordance with various parameters by, for example, using software if sufficient time is secured for executing such an operation before printing. In this case, the ink-refresh digital-ejection signal 1506 is not stored in the digital-ejection signal memory 1501, but is generated by the data processing portion 103 and output to the piezoelectric-element driver 402 through the digital-driving-signal generating unit 111.

For example, when the recording sheet 602 is lifted upward, there is a danger that the refreshing ink droplets 806 may reach the recording sheet 602 without being collected onto the metal mesh 802 and may form undesirable visible dots on the recording sheet 602. Taking this danger into consideration, the data processing portion 103 can generate an ink-refresh digital-ejection signal 1506 while referring to the ejection data 104, i.e., type of the images to be formed. For example, fine images, such as fine characters, graphs, images that require accurate whiteness, or the like, will be easily misinterpreted if unnecessary dots are formed on the recording sheet 602 by refresh ink droplets. In this case, the data processing portion 103 can control so as not to perform the ink refresh operation or to decrease the frequency of the ink refresh operation.

Also, clogging in the orifice 301 more likely occurs in arid environment, and so the period Pd can be set small when the ambient air is dry. For example, the period Pd is set to 2,048 when the humidity is equal to or greater than 70%, 1,024 when the humidity is 60% through 69%, 512 when the humidity is 50% through 59%, and 256 through 128 when the humidity is equal to or less than 49%. These settings of the period Pd can be manually made by a user or automatically made based on a detection signal from well-known temperature/humidity sensor.

Because the ink-collect electrode 801 is usually dry at the time of when a power switch of the inkjet recording device 1 is turned ON, the period Pd at this time can be set small to wet the ink-collect electrode 801 quickly with ink so as to maintain the high humidity around the orifice 301. In this manner, nozzle clogging can be prevented.

Figure 13:
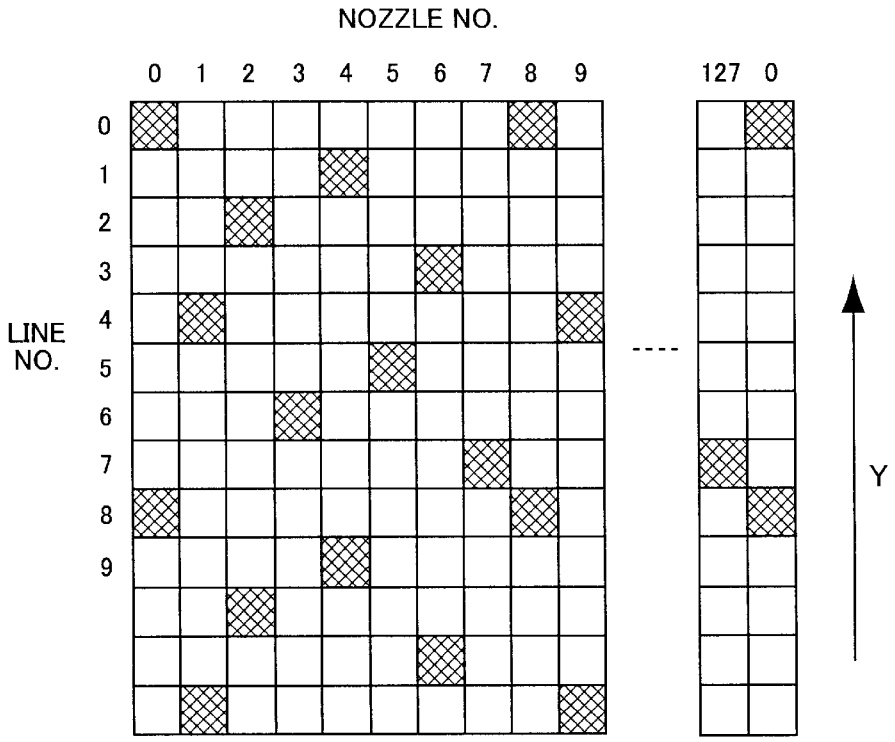
FIG. 13 is a second example of an ink-refresh digital-ejection signal.

Next, a second example of the ink refresh operation performed in the print device 1 will be described. FIG. 13 shows a second example of the ink-refresh digital-ejection signal 1506. In this embodiment, the period Pd=8, and the hashed cells representing "1" do not align in the x direction, but are distributed at random. In this case, even if the refreshing ink droplets 806 accidentally reach and form dots on the recording sheet 602 without being collected by the metal mesh 802 when, for example, the recording sheet 602 flows upward for some reasons, thus formed dots will be hardly noticed and thus will hardly degrade the overall image quality. This contrasts to the above-described first example where there is a danger that the refreshing ink droplet 806 may form on the recording sheet 602 a visible straight line in the x direction, which users may misunderstand consists original images.

Next, a third example of the ink refresh operation performed in the print device 1 will be described with reference to FIGS. 9, 14, and 15.

As described above, the ejection speed of the refreshing ink droplet 806 is set to 4 m/s so as to reliably collect the refreshing ink droplet 806 in the metal mesh 802. However, when the ejection speed is set slow, such as 4 m/s, then the ejection performance will become less stable, so that it is necessary to suppress the variation in ejection speeds of the refreshing ink droplet 806 among the nozzles 300 as much as possible.

Moreover, if the ejection speed drops as low as 2 m/s, then even slight change in ink clinging around the nozzle will undesirably angle the ink ejection direction or collect more ink around the nozzle. Such an ink accumulated near the nozzle will prevent ink ejection and worsen ink ejection performance. In worse case, ink ejection speed further decreases, whereby ink is scattered around to nearby nozzles, and ink ejection become impossible. In order to prevent these problems, it is necessary to achieve the ink ejection speed of 4 m/s precisely.

When there are a plurality of nozzles as in the present embodiment, a single print-driving signal 905 is used for driving all the nozzles 300, so that generally different print-driving signals 905 cannot be supplied individually to the nozzles 300 because of mechanical reasons. However, in the present embodiment, the refresh-driving signal 904 individually controls the ejection speed of the refresh ink droplet 806 for each of the nozzles 300 in the following manner so as to achieve precise ink ejection speed of 4 m/s.

Figure 14:
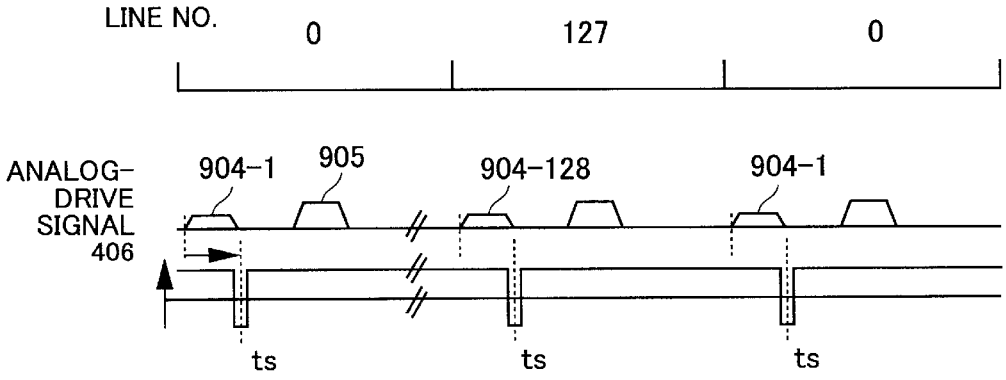
FIG. 14 is a timing chart of the piezoelectric-element driver according to a third example of the embodiment.

FIG. 14 shows a timing chart of the piezoelectric-element drivers 402 that is used in the present example. In the present example, the line-address generation unit 1001 shown in FIG. 9 is used and repeatedly counts 128 sheet-position synchronizing signals 109 to repeatedly generate 128 sets of the line address data 1006 of "0" through "127" (0, 1, 2, . . . , 127, 0, 1, . . . ) indicating line addresses. The memory 1003 stores 128 different refresh-driving signals 904-1 through 904-128, which are sequentially retrieved. The voltage of the refresh-driving signals 904-1 to 194-128 is set to gradually increase in this order such that the refresh-driving signal 904-1 has the smallest voltage, and the refresh-driving signal 904-128 has the largest voltage.

More specifically, a voltage with which the ejection speed of 4 m/s is achieved in average is set to 100%, then the voltage of the refresh-driving signal 904-1 is set to 80% of the voltage, and the voltage of the refresh-driving signal 904-128 is set to 120% of the voltage. The difference in voltage between successive refresh-driving signals 904 is set depending on the number of the corresponding nozzles 300.

Figure 15:
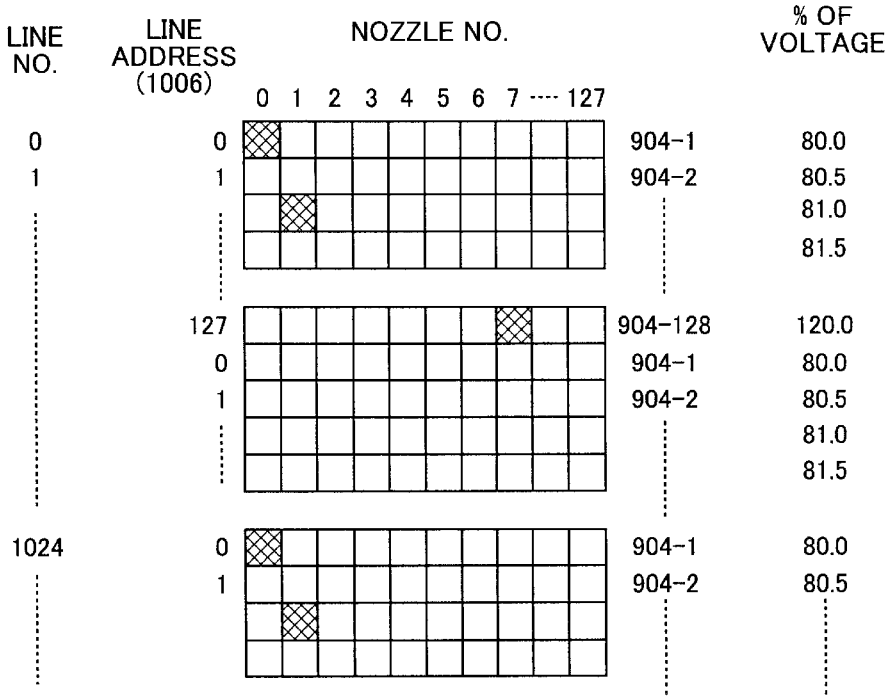
FIG. 15 is a third example of an ink-refresh digital-ejection signal.

FIG. 15 shows the ink-refresh digital-ejection signal 1506 and the output timing of the refresh-driving signal 904 according to the third example. Here, stable ink-jet performance of the nozzles 300 can be maintained by performing the ink refresh operations in 1,000-times frequency of the printing ink ejection. Accordingly, it is possible to perform ink refresh in each nozzle 300 using appropriate one of the refresh-driving signals 904-1 to 904-128 by generating these signals 904-1 to 904-128 in different line addresses 0 through 127 to which the refresh-driving signals 904-1 to 904-128 are assigned.

More specifically, when the ejection speed of ink droplets ejected from a certain nozzle 300 in response to a refresh-driving signal 904 with 100% voltage is too fast, then a refresh-driving signal 904 with less than 100% voltage is selected for the certain nozzle 300. When the ejection speed of ink droplets ejected from a different nozzle 300 in response to a refresh-driving signal 904 with 100% voltage is too slow, then a refresh-driving signal 904 with more than 100% voltage is selected for the different nozzle 300. This is because the ink ejection speeds can be controlled by adjusting the voltage of the refresh-driving signal 904 as described above referring to the formula.

In the example shown in FIG. 15, the ejection speed of the nozzle No. 0 is fast, so that the refresh-driving signal 904-1 with the 80% voltage is selected for the nozzle No. 0. The refresh-driving signal 904-2 with the 80.8% voltage is selected for the nozzle No. 1 because the ejection speed of the nozzle No. 1 is fast but slightly slower than the nozzle No. 0. In this manner, an appropriate one of the refresh-driving signals 904-1 to 904-128, i.e., the line addresses 0 to 127, is selected for each one of the nozzles 300. Then, the ink refresh is performed in a nozzle 300 in a line address corresponding to a selected refresh-driving signal 904-1 to 904-128.

The period Pd is set to 1,024 in this example, so the line addresses 0 through 127 repeats eight times (eight cycles) in the period Pd of 1,024. As shown in FIG. 15, the nozzle No. 0 performs ink refresh when the line address is 0, that is, in response to the refresh-driving signal 904-1. The piezoelectric-element driver 402 includes no other nozzles that eject ink refresh droplets when the line address is 0.

Here, it should be noted that unlike FIGS. 11 and 13 of the first and second examples, FIG. 15 shows the real output timing of the ink-refresh digital-ejection signal 1506, rather than a resultant dot pattern formed on the recording sheet 602 by ejected refreshing ink droplets 806. The same is true in FIG. 17 (described later).

When the line address is 1, no nozzle 300 performs ink refresh. When the line address is 2, the nozzle No. 2 performs ink refresh. When the line address is 3, no nozzles 300 performs ink refresh. In this manner, all the nozzles 300 perform the ink refresh once by the time the line address counts up to 127. When the line addresses repeats seven more times from 0 to 127 without the nozzles 300 performing ink refresh, the line number increases to 1,024, then the above operation is repeated starting from the nozzle No. 0.

In this manner, uniform ejection speeds of refresh ink droplets are achieved while suppressing the variation in ejection speeds among the nozzles 300, so that stable ink refresh can be maintained.

Here, in order to avoid interference among nozzles 300, it is preferable to control nozzles 300 that are located proximate to one another and assigned to the same refresh-driving signal 904-n to perform the ink refresh at different cycles, so that the ink refresh timing differs among these nozzles 300, that is, a large number of the proximate nozzles 300 are prevented from performing ink refresh at the same time.

Next, a fourth example of the ink refresh operation performed in the print device 1 will be described while referring to FIG. 16. In this embodiment, the ink refresh and ink vibration are used in combination. As described above, ink vaporizes more easily when humidity is lower, so that the ink refresh frequency can be increased when the humidity is low. However, increasing the frequency wastes ink, so that it is unfavorable that the period Pd be less than 128. Although it is conceivable to provide an ink collecting system to prevent wasting ink with using smaller period Pd, this will increase the number of components and thus costs of the inkjet recording device 1.

However, if the period Pd is set too large in a dry environment, then the ink will easily get dense and disable normal ink ejection. Accordingly, in the present example, an ink vibration is performed in addition to the ink refresh.

Figure 16:
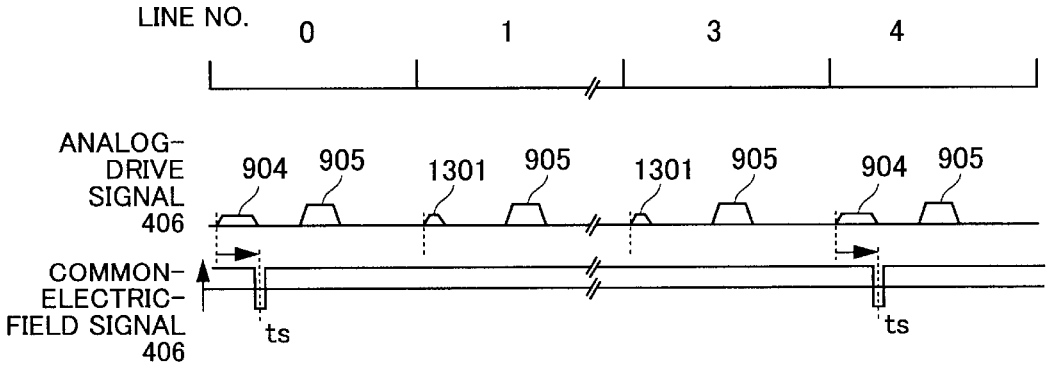
FIG. 16 is a timing chart of the piezoelectric-element driver according to a fourth example of the embodiment.

FIG. 16 shows a timing chart of the piezoelectric-element driver 402. The refresh-driving signal 904 is generated once every 4 lines, that is, in lines 4×n (n=0,1,2, . . . ), a vibration signal 1301 is generated three times every four lines. That is, the lines Nos. n through n+3 constitute one group, and the same operation is performed in each group. The vibration signal 1301 is for vibrating the meniscus 301M but not for ejecting any ink. There have been proposed vibration signals with various waveforms. For example, the vibration signal may be generated by lowering the voltage of the ejection signal, or may be generated with totally different waveform from that of the ejection signal. In the present embodiment, the trapezoidal waveform with small voltage shown in FIG. 16 is used.

Because the refresh-driving signal 904 is generated only once every four lines (4×n), the common-electric-field signal 113 will have the charging voltage of −1.5 kV only once every 4 lines. This elongates the time duration for applying the deflection voltage to the back electrode 805 while the refreshing ink droplets 806 are in flight, thereby making easier to collect the refreshing ink droplet 806.

Figure 17:
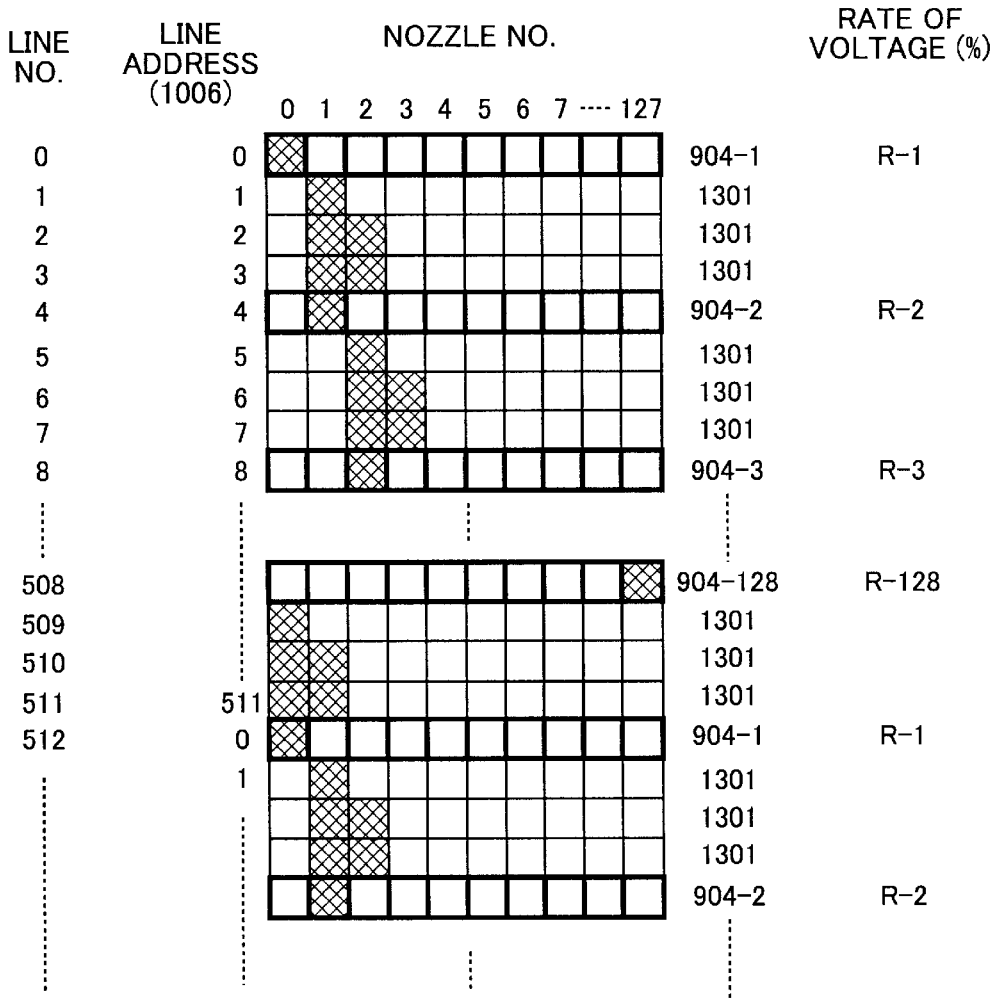
FIG. 17 is a fourth example of an ink-refresh digital-ejection signal.

FIG. 17 shows an ink-refresh digital-ejection signal 1506 (refresh-ink ejection signal 407R) of the present example. 128 nozzles from No. 0 through No. 127 are shown in the horizontal direction. In the vertical direction, the line Nos. and the line addresses are shown. In the present example, the line addresses repeat from 0 through 511. The hatched cells represent the ink-refresh digital-ejection signal 1506 of "1" and the white cells represent the signals of "0". As shown in FIG. 17, the analog drive signal 406 for all of the nozzles becomes refresh-driving signal 904 in lines No. 4n (N=0,1,2, . . . ) which are encircled with a bold line. In the remaining lines, the analog drive signal 406 for all the nozzles become the vibration signal 1301. In the present embodiment, when the line address is 4×n (n=0,1,2 . . . ), the ink refresh droplet is ejected only from the nozzle No. n.

Specifically, when the line No. and the line address are both 0, the ink-refresh digital-ejection signal 1506 for the nozzle No. 0 is 1, so that a refresh ink droplet is ejected from only the nozzle No. 0. When the line No. and the line address are both 1, the ink-refresh digital-ejection signal 1506 for the nozzle No. 0 is 1, so that the ink vibration is performed only in the nozzle No. 0. When the line number and the line address are both 2 and when the both are 3, the ink-refresh digital-ejection signal 1506 for the nozzles Nos. 1 and 2 are 1, so that the ink vibration is performed in the nozzles Nos. 1 and 2.

When the line No. and the line address are both 4, the ink-refresh digital-ejection signal 1506 for the nozzle No. 1 is 1, so that the refresh ink droplet is ejected from only the nozzle No. 1. When the line No. and the line address are both 5, the ink-refresh digital-ejection signal 1506 for the nozzle No. 2 is 1, so that the ink vibration is performed in the nozzles Nos. 2. When the line No. and the line address are both 6 and when the both are 7, the ink-refresh digital-ejection signal 1506 for the nozzles Nos. 2 and 3 are 1, so that the ink vibration is performed in the nozzles Nos. 2 and 3.

In the same manner, the operation is performed until the line No. and the line address both increase to 511. Then, the line address returns to 0 and then the same operation is repeated.

As described above, when the line address is 4×n (n=0,1,2 . . . ), the ink refresh droplet is ejected only from the nozzle No. n. Accordingly, the refresh-driving signal 904-n at that time can be a refresh-driving signal 904 prepared only for the nozzle No. n. Therefore, it is possible to determine an optimum one of rate of voltages R-1 through R-128 of the refresh-driving signal 904 for each of the nozzles 300 beforehand by performing experiments and to store waveforms specially prepared only for corresponding nozzles 300 into the memory 1003.

In this manner, the variation in ejection speeds of refresh ink droplets among the nozzles 300 can be suppressed, so the stable ink ejection can be performed. Also, in the present embodiment in the ink refresh operations, ink vibration is performed five times before the ink refresh is performed each time. For example, the nozzle No. 2 performs ink vibration in lines addresses of 2, 3, 5, 6, 7, and then performs ink refresh in the line address of 8. The nozzle No. 2 does not perform ink vibration in line address of 4 because the refresh-driving signal 904 is generated in the line address 4.

In the present embodiment, the number of the ink vibration before the ink refresh is set to 5. This number has been determined in the following manner.

The inventers have conducted experiments for confirming the effect of the ink vibration frequency (5 kHz at maximum) and the number of ink vibration on the ink ejection performance of the nozzles 300. Through the experiments, ink vibration frequency of 5 kHz, which equals to a dot frequency, is confirmed good for maintaining nozzle performances stable. On the other hand, the number of the ink vibration cannot be too many nor too small. Performing the ink vibration too many times will facilitate evaporation of the ink and thus clogging in the nozzles 300. Performing the ink vibration appropriate times is confirmed providing maximum effect.

In the present embodiment, performing ink vibration about 100 times at 5 kHz during 20 msec before each ink ejection is confirmed optimum. It is conceivable and possible to vibrate ink during 20 msec immediately before the print-ink ejection is performed by using software installed into the data processing portion 103. However this is generally difficult. In the present embodiment, ink is vibrated during 20 msec immediately before the refresh-ink ejection signal 407R is generated. Because the refresh-ink ejection signal 407R is periodically generated, generation of the refresh-ink ejection signal 407R is easily predicted, and thus the control of the ink vibration is relatively easy.

According to the present example, the variation in ink ejection speeds among the nozzles 300 is suppressed by generating a different refresh-driving signal 904 for each of the nozzles 300. Moreover, the vibrating ink immediately before the refresh ink ejection makes the ink refresh more stable.

Although the refresh-driving signal 904 is generated once ever four lines, and the vibration signal 1301 is generated three time every four lines, the frequency of the refresh-driving signal 904 could be increased or decreased in accordance with the ambient environment.

As described above, according to the present invention, it is possible to perform the ink refresh operation during the printing. Therefore, there is no need to stop printing or move the print head 501 out of a print region in order to perform the ink refresh operation.

While some exemplary embodiments of this invention have been described in detail, those skilled in the art will recognize that there are many possible modifications and variations which may be made in these exemplary embodiments while yet retaining many of the novel features and advantages of the invention.

What is claimed is:

1. A drop-on-demand inkjet recording device comprising:

an ejection means for ejecting ink droplets; and a driving signal generation means for generating a print-driving signal and a maintenance-driving signal, wherein the ejection means ejects print ink droplets as the ink droplets based on the print-driving signal, and the ejection means performs maintenance operations based on the maintenance-driving signal, and wherein the print ink droplets reach a recording medium to form dots on the recording medium, wherein the print-driving signal is repeatedly generated at a predetermined time interval, and the maintenance-driving signal is repeatedly generated at the predetermined interval in a time phase different from the print-driving signal.

2. The drop-on-demand inkjet recording device according to claim 1, wherein the predetermined time interval is a time duration required for forming a single dot on the recording medium.

3. The drop-on-demand inkjet recording device according to claim 1, further comprising an electric-field generation means for generating an electric field, and a collecting means, wherein the maintenance-driving signal is a refresh-driving signal, and the ejection means ejects refresh ink droplets based on the refresh-driving signal, and the electric field deflects the refresh ink droplets, and the collecting means collects the deflected refresh ink droplets, all of the refresh ink droplets being collected by the collecting means.

4. The drop-on-demand inkjet recording device according to claim 3, wherein the maintenance-driving signal is one of the refresh-driving signal and a vibration-driving signal, and the ejection means performs ink vibration based on the vibration-driving signal.

5. The drop-on-demand inkjet recording device according to claim 4, wherein the drive signal generation means selectively generates the refresh-driving signal and the vibration-driving signal in accordance with humidity of ambient air.

6. The drop-on-demand inkjet recording device according to claim 1, wherein the maintenance-driving signal is a vibration-driving signal, and the ejection means performs ink vibrations based on the vibration-driving signal.

7. The drop-on-demand inkjet recording device according to claim 1, wherein the ejection means includes a plurality of nozzles each including a piezoelectric element, and the print-driving signal and the maintenance-driving signal are selectively applied to the piezoelectric element of all the nozzles.

8. The drop-on-demand inkjet recording device according to claim 7, further comprising an ejection signal generation means for generating a print-ink ejection signal based on which the print-driving signal is selectively applied to the piezoelectric element, and also generating a refresh-ink ejection signal based on which the maintenance-driving signal is selectively applied to the piezoelectric element.

9. The drop-on-demand inkjet recording device according to claim 8, further comprising an address counter that repeatedly counts line addresses, wherein the ejection signal generation means generates the refresh-ink ejection signal based on a counter value of the address counter.

10. The drop-on-demand inkjet recording device according to claim 8, wherein the ejection signal generation means generates a print-ink ejection signal based on at least one of humidity of ambient air and a print signal.

11. The drop-on-demand inkjet recording device according to claim 7, wherein the drive signal generation means generates a plurality of maintenance-driving signals having different voltages one at a time, and each maintenance-driving signal is applied to a corresponding one of the nozzles.

12. The drop-on-demand inkjet recording device according to claim 1, wherein the driving signal generation means generates the print-driving signal and the maintenance-driving signal in alternation.

13. The drop-on-demand inkjet recording device according to claim 1, wherein the ejection means is a drop-on-demand inkjet head that selectively ejects ink droplets based on the print-driving signal.

14. A drop-on-demand inkjet recording device comprising:

an ejection means for ejecting ink droplets; and a driving signal generation means for generating a print-driving signal and a maintenance-driving signal, wherein the ejection means selectively ejects print ink droplets as the ink droplets based on the print-driving signal, and the ejection means performs maintenance operations based on the maintenance-driving signal, and wherein the print ink droplets reach a recording medium to form dots on the recording medium, wherein the print-driving signal is repeatedly generated at a predetermined time interval, and the maintenance-driving signal is generated at a timing between two successive print-driving signals.

15. The drop-on-demand inkjet recording device according to claim 14, further comprising an electric-field generation means for generating an electric field, and a collecting means, wherein the maintenance-driving signal is one of a refresh-driving signal and a vibration-driving signal;

the ejection means selectively ejects a refresh ink droplet based on the refresh-driving signal, and performs ink vibration based on the vibration-driving signal;

the electric field deflects the refresh ink droplets; and the collecting means collects the deflected refresh ink droplets.

* * * * *